United States Patent [19]

Giambalvo

[11] 4,241,669

[45] Dec. 30, 1980

[54] SHELF AND BRACKET ARRANGEMENT

[76] Inventor: Joseph Giambalvo, 1118 Willoughby Ave., Brooklyn, N.Y. 11237

[21] Appl. No.: 42,422

[22] Filed: May 25, 1979

[51] Int. Cl.[3] ..... A47B 5/00; A47B 10/00

[52] U.S. Cl. ..... 108/152; 108/108; 248/249; 248/250

[58] Field of Search ..... 108/108, 152, 25, 149; 248/221.1, 221.2, 249, 250; 182/120, 82; 312/209; 211/134, 135, 153

[56] References Cited

U.S. PATENT DOCUMENTS

| | | | |
|---|---|---|---|
| 176,512 | 4/1876 | Chinnery | 108/149 |
| 920,633 | 5/1909 | Oppenheimer | 248/249 X |
| 1,201,595 | 10/1916 | Kraemer | 248/249 X |
| 2,252,025 | 8/1941 | Olson | 108/149 |
| 2,940,602 | 6/1960 | Riedmaier et al. | 108/152 |
| 2,954,125 | 9/1960 | Husted | 108/62 |
| 3,244,125 | 4/1966 | Mackey | 108/25 |
| 3,559,814 | 2/1971 | Downing | 211/135 |
| 3,669,034 | 6/1972 | Marschak | 108/152 |
| 3,701,325 | 10/1972 | Fenwick | 108/1 |
| 3,799,072 | 3/1974 | Slaboden | 108/149 |
| 3,896,718 | 7/1975 | Giambalvo | 248/249 X |

FOREIGN PATENT DOCUMENTS

| | | | |
|---|---|---|---|
| 2641992 | 3/1978 | Fed. Rep. of Germany | 108/149 |
| 336271 | 10/1930 | United Kingdom | 182/120 |

*Primary Examiner*—James T. McCall

*Attorney, Agent, or Firm*—Browdy and Neimark

[57] ABSTRACT

A shelf arrangement includes two or more wire bracket members positively connected to a shelf member, each of the bracket members including an angularly extending upper extension terminating in a hook, and a generally horizontally extending lower extension, with the hook and the end of the lower extension being adapted to be lockably but detachably supported by apertures in a support arrangement. The shelf includes a notch in the vicinity of the intersection of the angularly extending upper extension and the horizontally extending lower extension of each bracket which maintains the bracket perpendicular to the shelf when inserting the bracket into the apertures of the support structure.

21 Claims, 7 Drawing Figures

FIG. 1
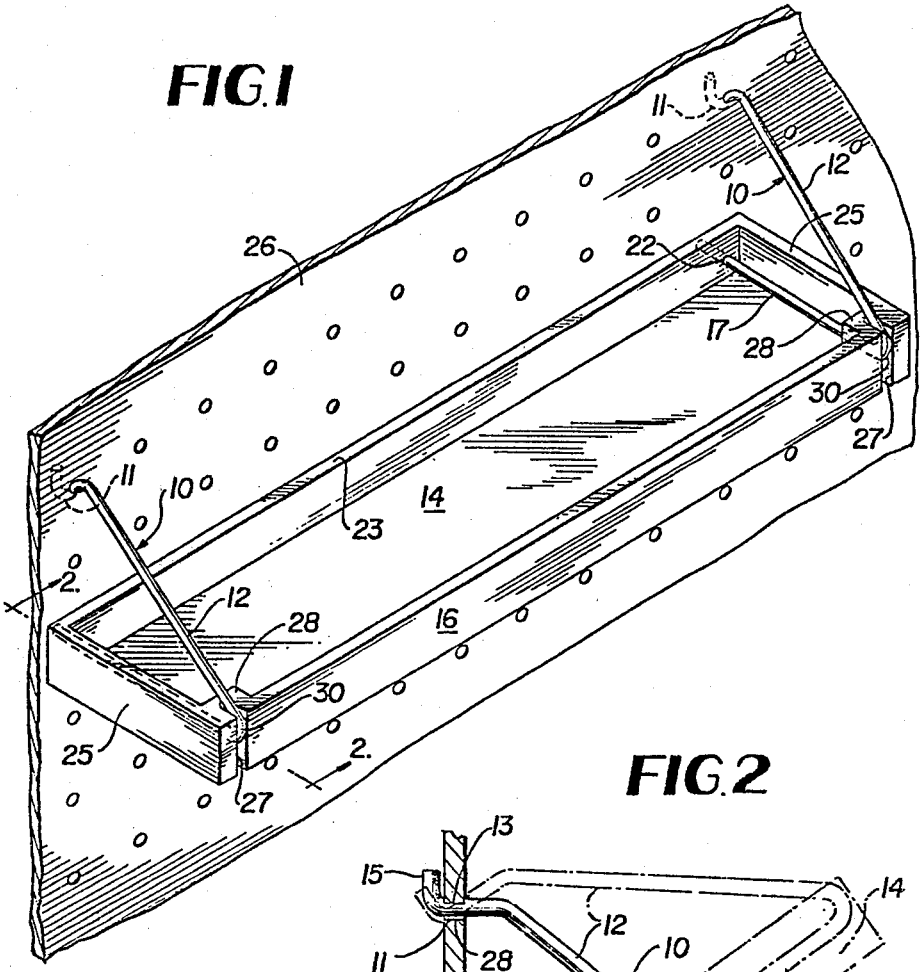
FIG. 2
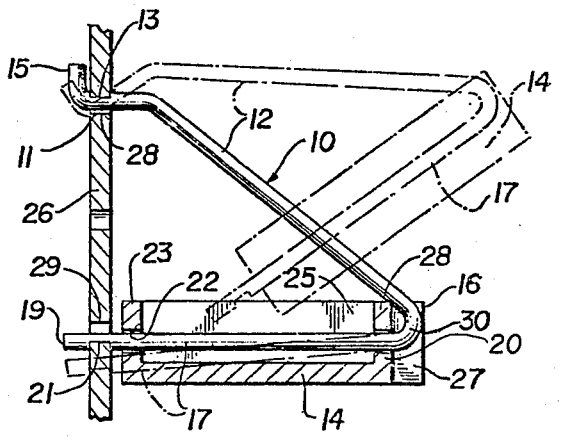
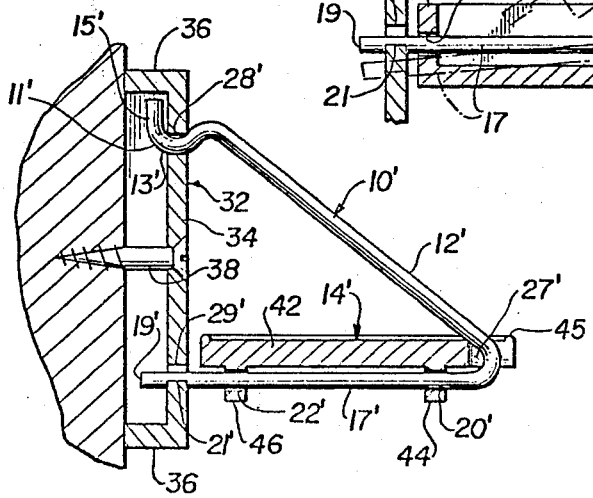
FIG. 4

FIG. 3
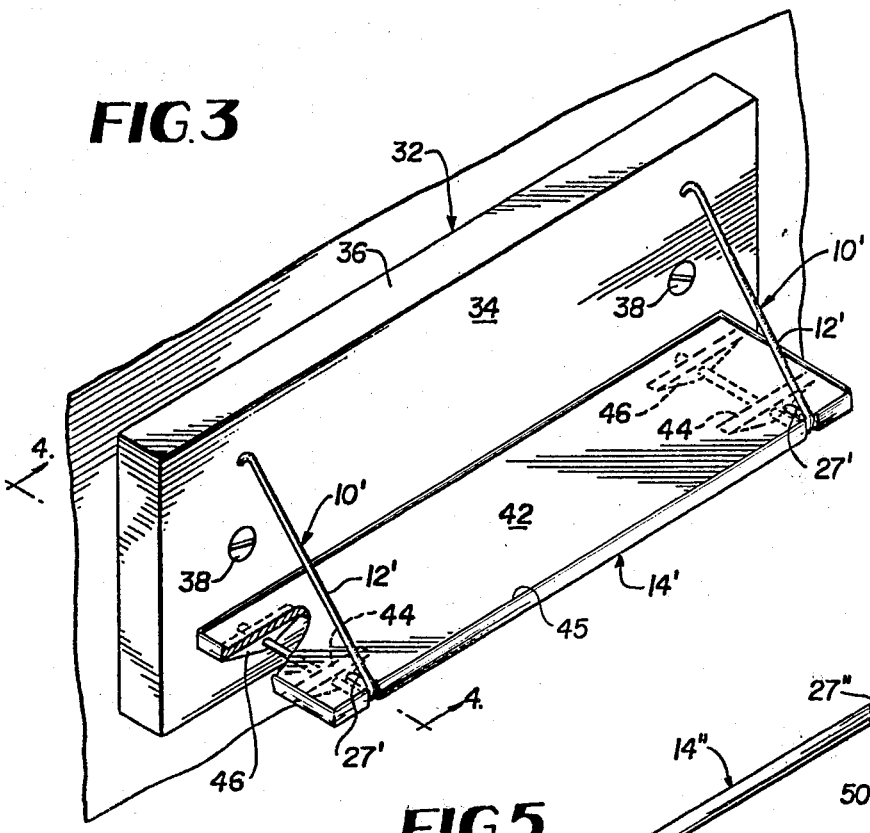
FIG. 5
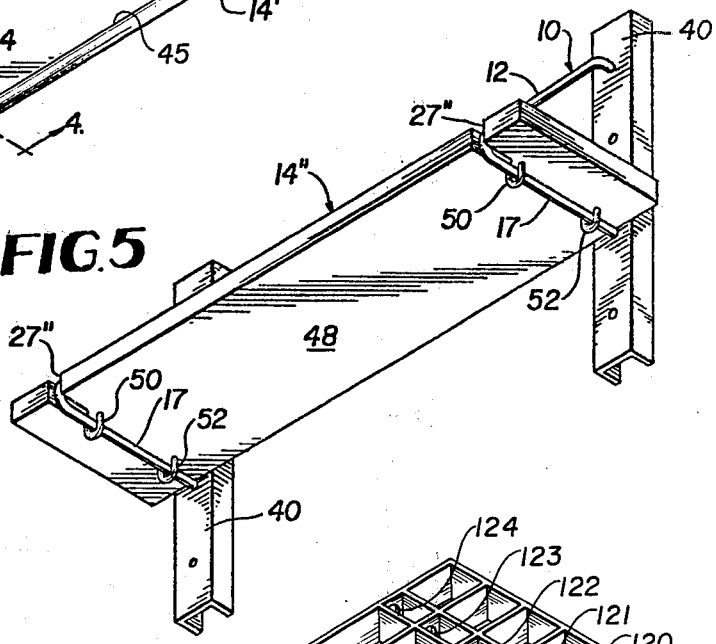
FIG. 6
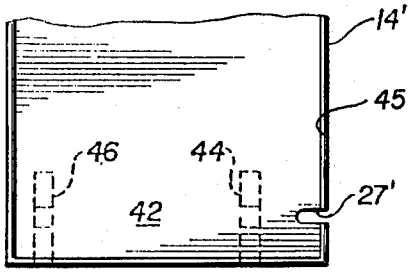
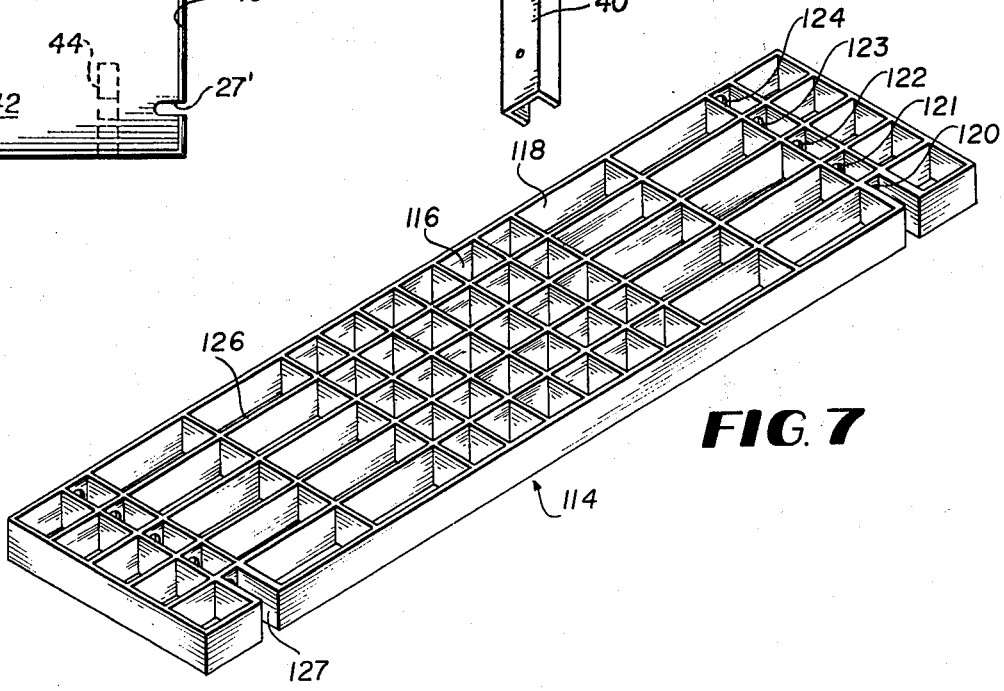
FIG. 7

SHELF AND BRACKET ARRANGEMENT

FIELD OF THE INVENTION

The present invention relates to a shelf arrangement including support brackets which are adapted to be removably inserted into channel posts, peg boards, or the like, with spaced apart apertures, and more particularly, to an improved shelf structure therefor.

BACKGROUND OF THE INVENTION

U.S. Pat. No. 3,896,718 of July 29, 1975 to the present applicant discloses the basic shelf and bracket arrangement of the present invention. The shelf arrangement of this patent has many advantages including quick assembly and disassembly, positive securement of the shelf member to the bracket member precluding lateral movement and/or accidental disassembly, and locking securement to the support structure.

One disadvantage of this known arrangement, however, is the possibility that the brackets may swivel with respect to the shelf member so that the bracket will not remain perpendicular to the shelf, and thus making it more difficult to align the bracket with the apertures of the support during installation.

SUMMARY OF THE INVENTION

Accordingly, it is an object of the present invention to eliminate these problems of the prior art.

It is a further object of the present invention to provide an improved shelf arrangement which may be easily and quickly secured to the apertures of the support member.

It is still another object of the present invention to provide a construction for a shelf member of such an arrangement which maintains the bracket perpendicularly to the shelf when inserting the bracket into the apertures of the support structure.

It is yet another object of the present invention to provide an improved shelf for such a construction, the flat surface of which has a raised edge to prevent items from rolling or sliding off.

It is still a further object of the present invention to provide a shelf for such a construction with open compartments therein for holding a very large number of tools.

These and other objects of the present invention will be better understood if reference is made to the following description of typical embodiments of the present invention as illustrated in the accompanying drawings.

BRIEF DESCRIPTION OF THE DRAWINGS

In the accompanying drawings in which the same reference numerals designate the same parts in all views:

FIG. 1 is a view in perspective of a shelf arrangement according to one embodiment of the present invention;

FIG. 2 is a sectional view of the shelf arrangement of FIG. 1 taken along line 2—2 of FIG. 1, the phantom lines thereof showing the shelf arrangement of the present invention in the process of insertion;

FIG. 3, shown on the second page of the drawings, is a view in perspective of a shelf arrangement according to a second embodiment of the present invention;

FIG. 4 is a sectional view of the shelf arrangement in FIG. 3 taken along line 4—4;

FIG. 5 is a view in perspective of a shelf arrangement according to still another embodiment of the present invention;

FIG. 6 is a fragmentary top view of the shelf of FIG. 3; and

FIG. 7 is a perspective view of a utility shelf which may be used in the present arrangement.

Referring now more particularly to the drawings, one of the preferred embodiments of the shelf arrangement according to the present invention may be seen in FIGS. 1 and 2 as comprising at least two spaced apart resilient wire brackets 10 each of which includes an angularly extending upper extension 12 terminating in a hook 11 at the upper end thereof. The lower end of upper extension 12 is formed with an angle to provide a generally horizontally extending lower extension 17. Hook 11 includes a generally horizontal portion with an upwardly directed notch 13 formed therein and an upwardly extending generally vertical end portion 15. Lower extension 17 terminates in end portion 19 and includes a downwardly directed notch 21 adjacent to but not at end portion 19. Debossed notch 21 may be formed by swaging but is preferably die cut.

Each bracket 10 is positively secured to a shelf member 14 which may preferably be made of a plastic material. In FIGS. 1 and 2, shelf member 14 includes front and rear vertical flanges 16 and 23, respectively, as well as side flanges 25. The flanges together make up an enclosed portion for the shelf portion 14 to aid in holding loose objects. Alternatively, the shelf 14 may be inverted so that the flanges extend downwardly and there are no obstructions on the planar shelf surface. Each bracket 10 is positively secured to shelf member 14 by apertures 20 and 22 of flanges 16 and 23, respectively, in which they are received.

Hook 11 of upper extension 12 and end portion 19 of lower extension 17 are adapted to be inserted into vertically spaced apertures in supporting means, such as a peg board 26, with oppositely directed notches 13 and 21 sprung apart to straddle the opposed edges of the respective apertures.

The resilient wire brackets 10 are so constructed such that each bracket is resiliently biased to a rest position at which the hook 11 of the upper extension 12 and the end 19 of the lower extension 17 are farther apart than the vertically spaced perforations of the peg board 26 into which the brackets are to be engaged. The rest position of lower extension 17 of bracket 10 is shown in double dashed phantom lines in FIG. 2.

The shelf member 14 is so constructed as to provide a notch 27 in the vicinity of each aperture 20 in the front flange 16. Notch 27 must be forward of aperture 20 and the walls of the notch must extend above aperture 20 to a sufficient extent to engage a portion of upper extension 12 of the bracket, or at least a portion of the angle 30 thereof. In this manner, when the bracket is fully inserted into the apertures 20 and 22 of the shelf member, the bracket 10 is maintained in a plane which is perpendicular to the plane of the shelf 14.

In the construction shown in FIGS. 1 and 2, the front flange 16 is formed with thicker portions 28 at the end thereof. The vertically extending notch 27 is cut into the thickened portion 28 and the aperture 20 is drilled at the rear of the notch 27 through the thickened portion 28 at approximately the center of the height of the thickened portion 28 of flange 16. By disposing the aperture 20 at the center of the height of the flange 16, it can be seen that the notch will be operable whether the shelf is arranged with the open ends upwardly as shown in FIGS. 1 and 2, or are arranged with flanges extending downwardly, not illustrated.

To assemble this shelf arrangement, the lower extension 17 of each racket 10 is inserted into aligned apertures 20 and 22 of flanges 16 and 23 respectively, of shelf member 14. The lower extension 17 of the bracket 10 extends sufficiently far into the apertures 20 and 22 of shelf member 14 to cause the upper extension 12 to become locked into a plane perpendicular to the plane of the shelf member 14 by the notch 27. End portion 15 of each bracket 10 is then inserted into horizontally aligned apertures in the peg board 26 as shown in phantom in FIG. 2. The brackets and associated shelf member are then pivoted downwardly until the end portions 19 of lower extension 17 of the brackets 10 contact the peg board 26. Due to the rest position of the resilient bias of the bracket 10, the end portions 19 will contact the peg board 26 just below the associated aperture 29 of the peg board. The lower extensions 17 are then squeezed toward the upper extension 12 against the bias of the bracket 10 a slight distance in order to permit the end portions 19 to be inserted into the associated apertures 29 of the peg board 26. Upon insertion of the end portions 15 and 19 into their associated apertures 28 and 29, notches 13 and 21 will spring apart due to the biased arrangement to assure straddling of the associated apertures 28 and 29 by the notches 13 and 21. Thus, a detachably locked supporting relationship is provided in the shelf arrangement. Due to the arrangement of notch 27 which locks the bracket 10 into a plane perpendicular to the plane of the shelf member 14, the end 19 cannot swing to the right and to the left of the associated apertures 29 of the peg board 26 but will be perfectly aligned therewith such that only a slight upward pressure will permit the insertion of the ends 19 into the apertures 29.

Alternative embodiments of the shelf arrangement of the present invention are illustrated in FIGS. 3–6. Instead of peg board 26, the support structure of the present invention may comprise a back plate 32. Back plate 32 includes apertures 28' and 29' corresponding to the apertures 28 and 29 of peg board 26 which receive the respective end portions of the bracket 10. The back plate 32 includes a front wall 34 and peripheral flanges 36 which support the front wall 34 a sufficient distance from a support surface upon which it is mounted to permit insertion of the bracket and shelf arrangement. The bracket may conveniently be attached to any support surface such a wall by means of screws 38. The brackets may conveniently be used with pegboards or other support surfaces having ¼" or 3/16" holes.

The support member, of course, may comprise any structure which contains apertures for receiving the ends of the bracket 10. For example, aperture channel posts 40 are illustrated in FIG. 5.

The bracket 10 itself may also be constructed in slightly varying embodiments. For example, the bracket according to the present invention may also take the form illustrated in FIGS. 3 and 4 in which bracket 10' differs from the earlier described bracket 10 in that the bracket 10' is formed with a U-shaped hook 11' including a depressed portion 13' and a vertical end portion 15' on the end of upper extension 12'. The lower extension 17' with end portion 19' and notch 21' are otherwise similar to parts of bracket 10 designated by corresponding unprimed reference numerals.

In further embodiments of the present invention, the structure and construction of the shelf member 14 may be varied as long as the function of the apertures 20 and 22 and the notch 27 are preserved. In the embodiment of the shelf member illustrated in FIGS. 3, 4 and 6, shelf 14' is constructed of a planar surface 42 with appendages 44 and 46 extending downwardly from the lower surface thereof. Appendages 44 and 46 have apertures 20' and 22' therethrough respectively, and are arranged so as to receive the lower extensions 17 or 17' of the bracket 10 or 10'. At the front of the shelf 14', there are provided notches 27' which are forward of the forward apendages 44. Since these notches 27' are necessarily above the level of the apertures 20', 22', they serve the same function as notches 27 in shelf 14. A raised ridge 45 may be present around the edges of the flat surface of the shelf 14' to prevent items rolling or sliding off. Such a ridge (not shown) may also be present on the undersurface, in the configuration shown in FIGS. 1 and 2, of shelf 14. Thus, when such a shelf is used in its inverted configuration, the ridge will be present to prevent items from rolling and sliding off.

Another variation of a shelf which is usable in the present invention is illustrated in FIG. 5. Shelf 14" of FIG. 5 may be made of a wooden slat or board 48 into which staples 50 and 52 are partly driven. The lower extension 17 of the bracket 10 may be inserted through these staples 50 and 52. Notch 27" is provided at the front of the board. Instead of staples 50 and 52, eye-bolts (not illustrated), or other suitable equivalents may be used.

It should be understood that notches 27 in the shelf members 14 not only serve the function of assuring a perpendicular arrangement of the brackets 10 with the shelf 14, but also permit the effective width of the shelf, from the front to the back, to be extended. For the same size brackets, the shelves of the shelf arrangement of U.S. Pat. No. 3,896,718 will be much narrower than would be permitted with the presence of notches. The width of the shelf could be extended considerably by increasing the depth of the notch 27.

FIG. 7 shows another variation of a shelf in the nature of a utility shelf which may be used to store a plurality of tools. Shelf 114 is preferably constructed of plastic comprising a plurality of intersecting thin walls 126. A notch 127 is provided at either side on the front of the shelf similarly to notch 27 of FIGS. 1 and 2. Apertures 120–124 in the thin walls permit passage of the lower extension of the bracket when in use. The interesting walls 126 leave a plurality of compartments 116, 118, of various sizes, which pass through the shelf. In the embodiment of FIG. 7, 60 compartments 116, 118 are shown. These compartments may be used for the storage of tools, such as screwdrivers and plyers, which pass through the open compartments and are retained by their handles in known fashion.

It should be understood that while several embodiments of the present invention have been illustrated and described herein, numerous other variations or modifications therein may occur to those having skill in this art and what is intended to be covered herein, is not only the illustrated forms of the present invention, but also any and all modified forms thereof as may come within the spirit of said invention as defined by the appended claims.

I claim:

1. In a shelf arrangement, comprising supporting means having vertically spaced perforations therebetween;

at least two open triangle brackets, each consisting of two sides, one of said sides comprising an upper extension terminating in a hook having a depressed portion therein, and the other of said sides comprising a generally horizontally extending lower extension connected at one end to the end of said upper extension opposite said hook and terminating at the other end thereof without the axis thereof departing from said generally horizontal line, the terminal end thereof having a downwardly directed notch therein, said upper extension extending from said horizontally extending lower extension at an acute angle, said upper and lower extensions being resiliently biased to a rest position at which said hook and the end of said lower extension are farther apart than the vertically spaced perforations of said supporting means in which said brackets are engaged; and a shelf member having two apertures through which said lower extensions of respective ones of said brackets extend to support said shelf member in a horizontal position, thereby positively connecting said brackets with said shelf member, the depressed portion of said hook and the notch in the terminal end of said lower extension of each of said brackets lockably engaging the said vertically spaced perforations in said supporting means, the improvement wherein said shelf member further includes, for each said bracket, a notch means for maintaining said bracket in a plane perpendicular to that of said shelf member, each said notch means comprising a single three-walled notch formed in said shelf member such that the upper extension of said bracket must pass therethrough.

2. A shelf arrangement in accordance with claim 1, wherein each said notch is disposed in the side of said shelf member opposite said supporting means, extends above the level of the aperture through which the respective one of said brackets extend, and is vertically aligned with said aperture, the width of each said notch being substantially equal to the width of the sides of said brackets.

3. A shelf arrangement in accordance with claim 1 or 2, wherein said shelf member includes flanges around the periphery thereof, said flanges extending generally vertically when said shelf member is in a horizontal position, said apertures being through said flange, and wherein the flange on the side of the said shelf member opposite said supporting means is of sufficient thickness, at least in the vicinity of said apertures, to permit the formation of said notch means therein.

4. A shelf arrangement in accordance with claim 1, wherein said shelf member comprises a support surface and a plurality of aperture forming means, extending from the lower surface thereof, forming said apertures, said notch means being formed in the support surface thereof.

5. A shelf arrangement in accordance with claim 2, wherein said shelf member comprises a support surface and a plurality of aperture forming means, extending from the lower surface thereof, forming said apertures, said notch means being formed in the support surface thereof.

6. A shelf arrangement in accordance with claim 4 or 5, wherein each of said aperture forming means comprises an appendage with an aperture therethrough.

7. A shelf arrangement in accordance with claim 4 or 5, wherein said aperture forming means is at least one staple partially inserted into the lower surface of said support surface, said aperture being defined on one side by said support surface, and on the remaining sides by said staple.

8. A shelf arrangement in accordance with claim 1, 2 or 4, wherein the depressed portion of said hook in said brackets is a notch in the surface thereof directed upwardly.

9. A shelf arrangement in accordance with claim 1, 2 or 4, wherein said hook in said brackets is generally U-shaped, opening upwardly, the bottom of the U forming said depressed portion.

10. A shelf arrangement in accordance with claim 1, 2 or 4, wherein said brackets are formed from metal, wire or like wire-shaped resilient material.

11. A shelf arrangement in accordance with claim 1, 2 or 4, wherein supporting means comprises a channel post having vertically spaced perforations therein.

12. A shelf arrangement in accordance with claim 1, 2 or 4, wherein said supporting means comprises a perforated support.

13. A shelf arrangement in accordance with claim 1, 2 or 4, wherein said supporting means comprises a backing plate having two columns of at least two vertically spaced perforations therein.

14. A shelf arrangement in accordance with claim 1 wherein said shelf member has at least one planar surface adaptable to be in a horizontal load-supporting position when in use, said surface having a raised ridge around the edges thereof.

15. A shelf arrangement in accordance with claim 2 wherein said shelf member comprises a utility shelf formed of a plurality of intersecting vertically extending, when the shelf member is in a horizontal position, thin walls forming a plurality of open topped and bottomed compartments in said shelf member, the upper ends of said intersecting thin walls forming a support surface on said shelf member when in use, said apertures passing through said walls and said notch means comprising one of said compartments with the deletion of that part of said thin walls which would otherwise have closed said compartments on the side shelf member opposite said supporting means.

16. A shelf member, adapted to be supported by the lower horizontal sides of at least two two-sided open triangle brackets each having a lower horizontal side and an upper angularly extending side connected at one end to one end of the lower side, the free ends of said brackets adapted to be inserted into a perforated support structure, said shelf member having two apertures through which said lower horizontal sides of respective ones of said brackets extend and further having, for each said bracket, a notch means for maintaining the bracket in a plane perpendicular to that of said shelf member when the bracket is inserted into said apertures, said notch means comprising a single three-walled notch formed in said shelf member such that the upper side of the bracket must pass therethrough when the lower side is inserted into said aperture.

17. A shelf member in accordance with claim 16 wherein each said notch is disposed in the side of the shelf member opposite the support structure when in use, extends above the level of the aperture through which the respective one of said brackets extend, and is vertically aligned with said aperture, the width of each said notch being substantially equal to the width of the sides of the brackets.

18. A shelf member in accordance with claims 16 or 17 including flanges around the periphery thereof, said flanges extending generally vertically when the shelf member is in a horizontal position, said apertures being through said flanges, and wherein the flange on the side of the shelf member opposite the support structure when in use is of sufficient thickness, at least in the vicinity of said apertures, to permit the formation of said notch means therein.

19. A shelf member in accordance with claim 16 comprising a support surface and a plurality of aperture forming means, extending from the lower surface thereof, forming said apertures, said notch means being formed in the support surface thereof.

20. A shelf arrangement in accordance with claim 16 wherein the shelf member has at least one planar surface adaptable to be in a horizontal load-supporting position when in use, said surface having a raised ridge around the edges thereof.

21. A shelf member in accordance with claim 16 comprising a utility shelf formed of a plurality of intersecting vertically extending, when the shelf member is in a horizontal position, thin walls forming forming a plurality of open topped and bottomed compartments in said shelf member the upper ends of said intersecting thin walls forming a support surface on said shelf member when in use, said apertures passing through said walls and said notch means comprising one of said compartments with the deletion of that part of said thin walls which would otherwise have closed said compartments on the side of said shelf member opposite said supporting means.

* * * * *